US010433411B2

(12) United States Patent
Aiba et al.

(10) Patent No.: US 10,433,411 B2
(45) Date of Patent: Oct. 1, 2019

(54) PLASMA GENERATING APPARATUS, THERAPEUTIC METHOD, AND METHOD FOR ACTIVATING CELL OR LIVING TISSUE

(71) Applicant: SEKISUI CHEMICAL CO., LTD., Osaka (JP)

(72) Inventors: Hiroaki Aiba, Kyoto (JP); Tsuyoshi Uehara, Kyoto (JP); Yu Nagahara, Kyoto (JP); Takaya Oshita, Kyoto (JP); Yoshishige Takikawa, Kyoto (JP); Mikimoto Kanazashi, Yokohama (JP); Akira Morooka, Tokyo (JP)

(73) Assignee: SEKISUI CHEMICAL CO., LTD., Osaka (JP)

( * ) Notice: Subject to any disclaimer, the term of this patent is extended or adjusted under 35 U.S.C. 154(b) by 0 days.

(21) Appl. No.: 15/995,912

(22) Filed: Jun. 1, 2018

(65) Prior Publication Data

US 2018/0368245 A1 Dec. 20, 2018

Related U.S. Application Data

(60) Provisional application No. 62/520,581, filed on Jun. 16, 2017.

(51) Int. Cl.
*H05B 33/00* (2006.01)
*H05H 1/24* (2006.01)

(52) U.S. Cl.
CPC ... *H05H 1/2406* (2013.01); *H05H 2001/2412* (2013.01); *H05H 2001/2443* (2013.01); *H05H 2240/10* (2013.01); *H05H 2245/122* (2013.01)

(58) Field of Classification Search
CPC . H01L 2924/00014; H01L 2224/05624; H01L 2224/05647; H01L 2924/12042; H01L 21/3065; H01L 2224/05099; H01L 2924/00; H01L 21/3145; H01L 21/3185; H01L 21/6835; H01L 21/7682; H01L 2224/05001; H01L 2224/05022; H01L 2224/05548; H01L 2224/05571; H01L 2224/11003; H01L 2224/11334; H01L 2224/13099; H01L 24/11; H01L 24/13;
(Continued)

(56) References Cited

U.S. PATENT DOCUMENTS

2012/0080412 A1* 4/2012 Holbeche ..... A61B 18/042 219/121.48
2014/0360867 A1* 12/2014 Tierney ..... H05H 1/24 204/260
2015/0084508 A1* 3/2015 Kondo ..... H01J 37/32532 315/111.01

FOREIGN PATENT DOCUMENTS

JP 5225476 7/2013

* cited by examiner

*Primary Examiner* — Monica C King
(74) *Attorney, Agent, or Firm* — Wenderoth, Lind & Ponack, L.L.P.

(57) ABSTRACT

A plasma generating apparatus including: a plasma generating unit including a tubular dielectric to which an atmospheric pressure plasma generation gas is introduced, an inner electrode extending in a hollow portion of the tubular dielectric in axial direction of the tubular dielectric and having a coil shape or an irregular surface, and an outer electrode provided on the outside of the tubular dielectric, the inner electrode and the outer electrode being positioned opposite to each other through the tubular dielectric; and a discharge port for discharging an active gas containing active species generated by the atmospheric pressure plasma generated in the plasma generating unit.

13 Claims, 5 Drawing Sheets

(58) Field of Classification Search
CPC . H01L 2924/01004; H01L 2924/01005; H01L 2924/01006; H01L 2924/01009; H01L 2924/0101; H01L 2924/01011; H01L 2924/01012; H01L 2924/01013; H01L 2924/01015; H01L 2924/01016; H01L 2924/01019; H01L 2924/0102; H01L 2924/01022; H01L 2924/01027; H01L 2924/01029; H01L 2924/0103; H01L 2924/01033; H01L 2924/01039; H01L 2924/01042; H01L 2924/01047; H01L 2924/01054; H01L 2924/01056; H01L 2924/01074; H01L 2924/01075; H01L 2924/01077; H01L 2924/01078; H01L 2924/01079; H01L 2924/01082; H01L 2924/01087; H01L 2924/01088; H01L 2924/014; H01L 2924/10329; H01L 2924/13091; H01L 2924/14; H01L 2924/3025; H05H 1/2406; H05H 1/48; H05H 2001/2412; H05H 2001/3478
See application file for complete search history.

PLASMA GENERATING APPARATUS, THERAPEUTIC METHOD, AND METHOD FOR ACTIVATING CELL OR LIVING TISSUE

CROSS-REFERENCES TO RELATED APPLICATION

This application claims the benefit of U.S. Provisional Application No. 62/520,581, filed Jun. 16, 2017, the entire content of which is incorporated herein by reference in its entirety.

BACKGROUND OF THE INVENTION

Field of the Invention

The present invention relates to a plasma generating apparatus, a therapeutic method, and a method for activating a cell or a living tissue.

Description of the Related Art

Heretofore, an apparatus for generating atmospheric pressure plasma has been used for surface cleaning of semiconductor substrates, glass substrates, various films and the like. In general method for generating atmospheric pressure plasma, an alternating voltage is applied between opposing electrodes to generate glow discharge plasma between the electrodes. The plasma treatment by glow discharge is roughly categorized into a direct method in which a target is placed in a discharge space between the electrodes, and a remote method in which active species are blown out from a discharge space toward a target. When there is a risk of electrical damage to the target, the remote method is adopted.

In a remote method plasma generator, the electrode arrangement as illustrated in FIG. 5 may be adopted in some cases. FIG. 5 is a schematic cross-sectional view of a plasma generating unit of a conventional plasma generating apparatus 100. The plasma generating apparatus 100 includes a gas pipe 101 into which a plasma generation gas is introduced from its rear end toward its front end, a pair of electrodes 102*a* and 102*b* disposed on a side surface of a tip end of the pipe, and a nozzle 103 for housing the electrodes and the tubular dielectric. The gas pipe 101 is hollow and is an insulator. Gas (G) discharged from the tip end of the gas pipe 101 is ionized between the pair of electrodes 102*a* and 102*b* (plasma generation area) disposed opposite to each other at a position ahead of the tip end, to thereby generate atmospheric pressure plasma. The atmospheric pressure plasma is discharged outward from the discharge port of the nozzle 103.

Since atmospheric pressure plasma discharged from a conventional plasma generating apparatus has a high temperature, such plasma is not suitable for application to soft material containing moisture. For example, when the plasma is applied to living bodies such as cells, living tissues, whole bodies of organisms and the like, cells and tissues may be subjected to excessive heat stress.

For solving the above problem, Patent Document 1 discloses an atmospheric pressure, low temperature microplasma ejecting apparatus. In this apparatus, a large number of holes are formed in a positive electrode of the plasma generating unit, and this apparatus is described as being capable of discharging an atmospheric pressure plasma (normal pressure plasma) of a relatively low temperature around 41° C. by applying a voltage of 2 to 3 kV between the positive electrode and a negative electrode which also serves as a gas tube.

PRIOR ART REFERENCES

Patent Document

Patent Document 1: Japanese Patent Granted Publication No. 5225476

SUMMARY OF THE INVENTION

Problems to be Solved by the Invention

However, since the positive electrode of the plasma generating apparatus described in Patent Document 1 has many fine pores having a diameter of 100 μm or less that generate plasma and allow the plasma to transmit therethrough, the electrode inevitably has a complicated structure. The manufacture of this electrode requires a fine patterning technique used in the field of MEMS (Micro Electro Mechanical Systems), which poses a problem of increased manufacturing cost for the electrode.

The present invention has been made in view of the above circumstances, and provides a plasma generating apparatus having a simple structure. Also provided are a therapeutic method, a method for activating a cell, and a method for activating a living tissue, which are applicable to medical use.

Means to Solve the Problems

[1] A plasma generating apparatus including:

a plasma generating unit including a tubular dielectric to which an atmospheric pressure plasma generation gas is introduced, an inner electrode extending in a hollow portion of the tubular dielectric in axial direction of the tubular dielectric and having a coil shape or an irregular surface, and an outer electrode provided outside of the tubular dielectric, the inner electrode and the outer electrode being positioned opposite to each other through the tubular dielectric; and a discharge port for discharging an active gas containing active species generated by the atmospheric pressure plasma generated in the plasma generating unit.

[2] The plasma generating apparatus according to [1], wherein the outer electrode has a cylindrical shape surrounding an outer peripheral portion of the tubular dielectric.

[3] The plasma generating apparatus according to [1], wherein the discharge port has a size that allows the discharge port to be inserted into a human oral cavity.

[4] The plasma generating apparatus according to [1], which further includes a dose control device that controls a discharge amount of the active gas.

[5] A therapeutic method using the plasma generating apparatus of [1], which includes applying an alternating voltage between the outer electrode and the inner electrode to apply the active gas to an affected part of a patient.

[6] The therapeutic method according to [5], wherein an alternating voltage of less than 20 kVpp and less than 20 kHz is applied between the outer electrode and the inner electrode.

[7] The therapeutic method according to [5], wherein an amount of the atmospheric pressure plasma generation gas introduced into the tubular dielectric is controlled so as to control the dose of the active gas discharged from the discharge port to less than 5.0 liter per minute.

[8] The therapeutic method according to [5], wherein at least one of the alternating voltage and the amount of the atmospheric pressure plasma generating gas introduced into the tubular dielectric is controlled to adjust the temperature of the active gas to 40° C. or less as measured at 1 mm or more and 10 mm or less away from the discharge port.

[9] The therapeutic method according to [5], wherein the atmospheric pressure plasma generation gas is nitrogen gas.

[10] The therapeutic method according to [5], wherein the affected part is a periodontal tissue or a tooth.

[11] The therapeutic method according to [5], wherein the affected part is an epithelial tissue.

[12] A method for activating a cell by using the plasma generating apparatus of [1], which includes applying an alternating voltage between the outer electrode and the inner electrode to generate an active gas, and applying the active gas to the cell.

[13] A method for activating a living tissue by using the plasma generating apparatus of [1], which includes applying an alternating voltage between the outer electrode and the inner electrode to generate an active gas, and applying the active gas to the living tissue.

Effect of the Invention

The plasma generating apparatus of the present invention has a simple structure and can be manufactured at relatively low cost.

DESCRIPTION OF THE EMBODIMENTS ((Plasma Generating Apparatus))

Figure 1:
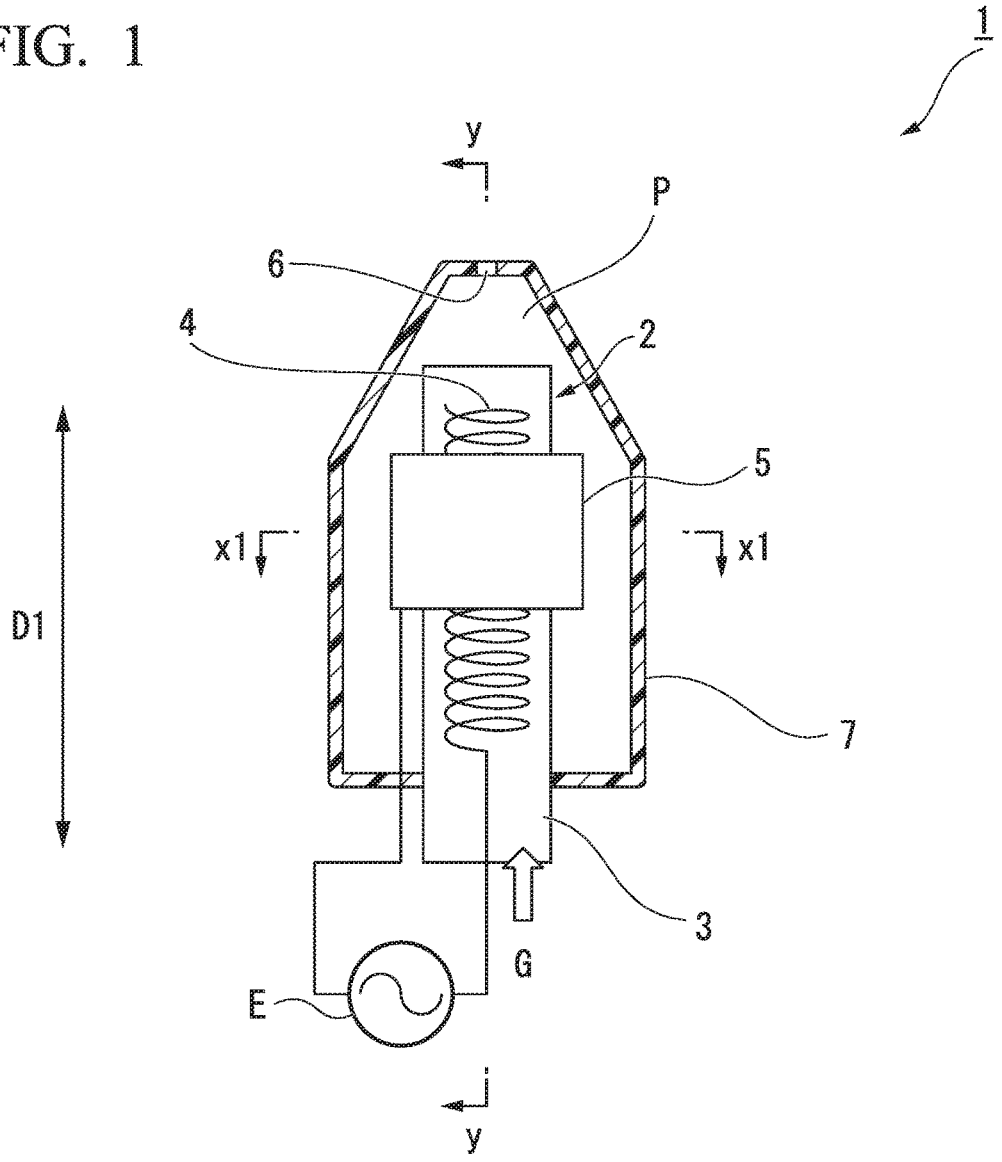
FIG. 1 is a schematic view of the plasma generating apparatus according to an embodiment of the present invention.

FIG. 1 shows major parts of a plasma generating apparatus 1 according to a first embodiment of the present invention.

The plasma generating apparatus 1 includes a plasma generating unit 2 and a discharge port 6. The plasma generating unit 2 ionizes the atmospheric pressure plasma generation gas G to generate an atmospheric pressure plasma. The discharge port 6 discharges outward the active gas P containing the active species generated by the atmospheric pressure plasma.

The active gas P refers to a gas having high chemical activity and including any of active species such as radicals, excited atoms, excited molecules, ions, and the like. The active gas P may be a gas composed only of active species or may contain other gas having a high chemical activity as well as the active species.

The plasma generating unit 2 includes a tubular dielectric 3 to which an atmospheric pressure plasma generation gas G is introduced, an inner electrode 4 extending in a hollow portion of the tubular dielectric 3 in axial direction (direction of arrow D1) of the tubular dielectric 3 and having a coil shape or an irregular surface, and an outer electrode 5 provided outside of the tubular dielectric 3, the inner electrode 4 and the outer electrode 5 being positioned opposite to each other through the tubular dielectric 3. The materials constituting the inner electrode 4 and the outer electrode 5 are not particularly limited as long as the materials are electrically conductive, and metals used for electrodes of known plasma generating apparatuses can be used. A power supply E for applying a voltage between the electrodes is connected to the inner electrode 4 and the outer electrode 5.

A cylinder (not shown) for supplying the atmospheric pressure plasma generation gas G is connected to a first end portion (rear end portion) of the tubular dielectric 3 via piping. The material of the tubular dielectric 3 is not particularly limited, and a dielectric material used in a known plasma generator can be used, the examples of which include glass, ceramics, synthetic resins, and the like. The lower the dielectric constant of the tubular dielectric 3, the more preferable. The shape of cross-section orthogonal to the axial direction D1 of the tubular dielectric 3 is not particularly limited, and examples thereof include a circle, an ellipse, a square, a hexagon, and the like.

In the cowling 7, the outer electrode 5, the tubular dielectric 3 and the inner electrode 4 are accommodated in the hollow portion thereof. This configuration enables prevention of electric shock caused by inadvertent physical contact with the outer electrode 5 or the inner electrode 4 from the outside. It is preferable that the cowling 7 is made of an insulating material.

The upper end of the cowling 7 has a tapered shape, and the discharge port 6 for introduction of the active gas P opens at the top of the upper end of the cowling 7. The discharge port 6 is located on the extension line of the axis of the tubular dielectric 3 and above the top of the tubular dielectric 3.

Figure 2:
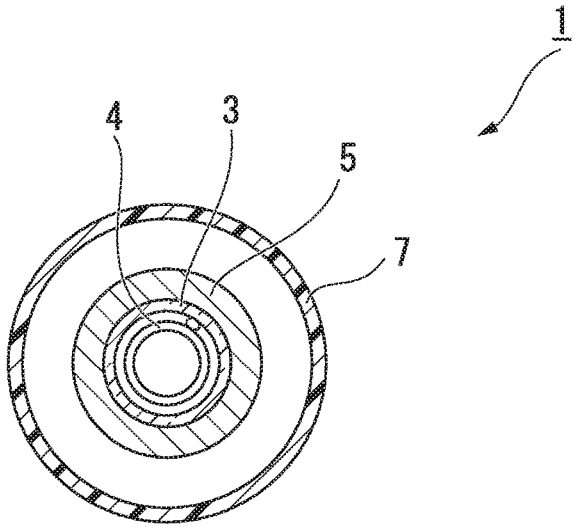
FIG. 2 is a cross-sectional view of the plasma generating apparatus as viewed from the arrow direction of the x1-x1 line of FIG. 1.

FIG. 2 is a cross-sectional view of the plasma generating apparatus as viewed from the arrow direction of the x1-x1 line of FIG. 1. The cylindrical cowling 7, the cylindrical outer electrode 5, the tubular dielectric 3, and the coiled inner electrode 4 are concentrically arranged from the periphery to the center in this order. The outer electrode 5 is disposed in close contact with the outer peripheral surface of the tubular dielectric 3. The inner electrode 4 is disposed at a predetermined distance from the inner peripheral surface of the tubular dielectric 3.

Figure 3:
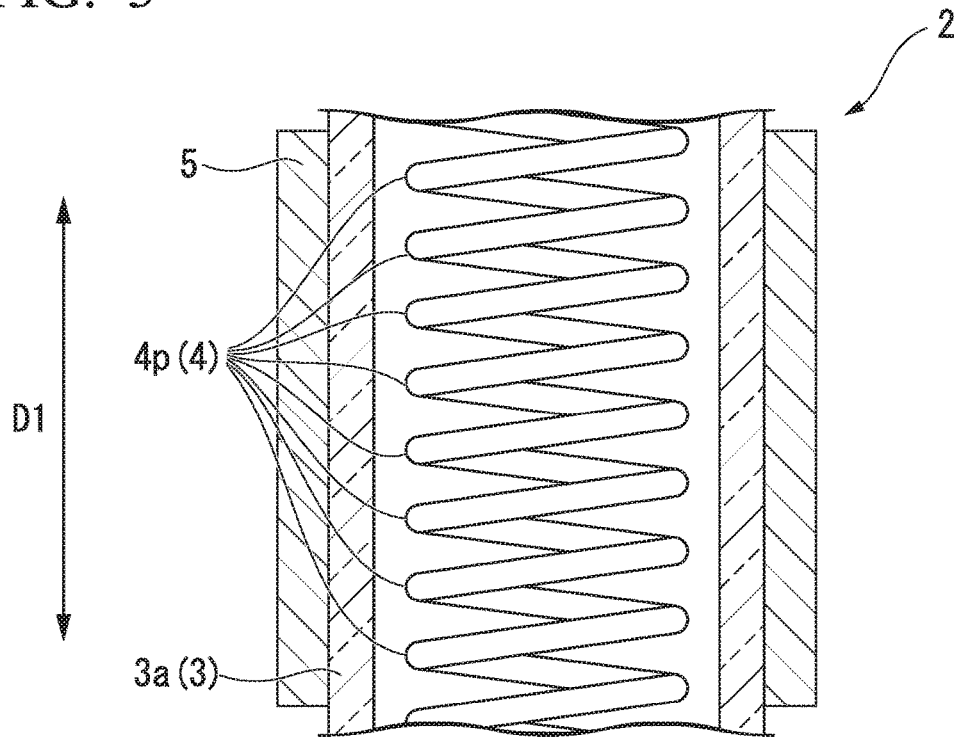
FIG. 3 is a cross-sectional view of the plasma generating apparatus as viewed from the arrow direction of the y-y line of FIG. 1.

FIG. 3 is a cross-sectional view of the plasma generating apparatus as viewed from the arrow direction of the y-y line of FIG. 1. However, the cowling 7 is omitted and not shown.

As shown in FIG. 3, the longitudinal directions of the tubular dielectric 3, the outer electrode 5 and the inner electrode 4 are the same (in the direction of arrow D1). In this cross section, the outer peripheral surface of the coil of the inner electrode 4 faces the inner peripheral surface of the outer electrode 5 through the tube wall 3*a* of the tubular dielectric 3. In the cross-sectional view, the inner electrode 4 is in proximity to the outer electrode 5 at multiple points 4*p*. In the cross-sectional view, the respective points 4*p* are spaced apart from each other in the axial direction D1 and are arranged dispersedly. In addition, the points 4 *p* are spirally continuous along the inner surface of the tubular dielectric 3.

This configuration enables prevention of local overheating of the inner electrode 4 to which the voltage is applied, and allows for easy generation of a low temperature atmospheric pressure plasma, which can lower the temperature of the active gas P.

The respective intervals between the points 4*p* of the coil of the inner electrode 4 and the outer electrode 5 may be the same or different. It is preferable that two or more of the multiple adjacent points 4*p* are positioned close to the inner peripheral surface of the outer electrode 5 with such an interval that allows generation of an atmospheric pressure plasma. The interval that allows easy generation of a low temperature, atmospheric pressure plasma is, for example, 0.01 to 2.0 mm.

The shape of the inner electrode 4 provided in the plasma generating apparatus 1 is not limited to the coil shape, and may be a shape having irregularities on the electrode surface facing the outer electrode 5. For example, the inner electrode 4 may have a rod-like shape or a cylindrical shape, each having a plurality of protrusions, grooves, holes, or through holes formed on the outer peripheral surface thereof. The shape of cross-section orthogonal to the axial direction D1 of the inner electrode 4 is not particularly limited, and examples thereof include a circle, an ellipse, a square, a hexagon, and the like.

In addition, the inner electrode 4 may have any other shape than mentioned above as long as the inner electrode 4 faces the inner surface of the outer electrode 5 at a plurality of positions on the outer peripheral surface in the cross section along the axial direction D1.

Figure 4A:
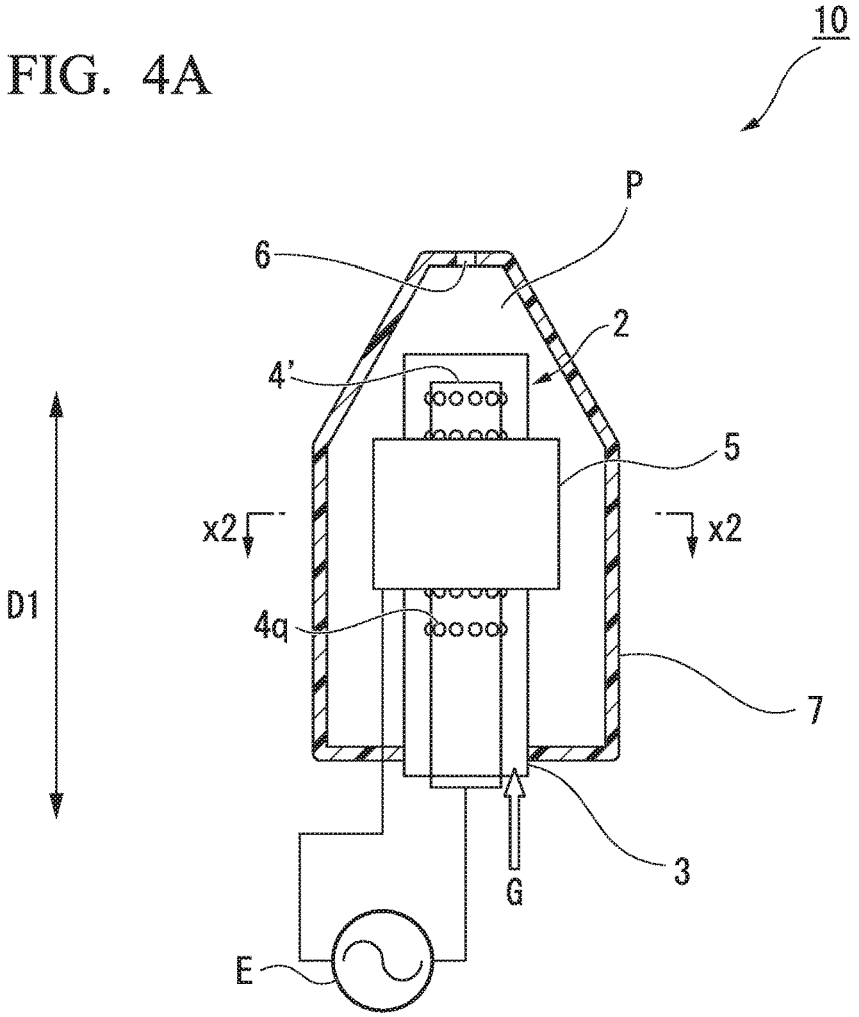
FIG. 4A is a schematic view of the plasma generating apparatus according to another embodiment of the present invention.
Figure 4B:
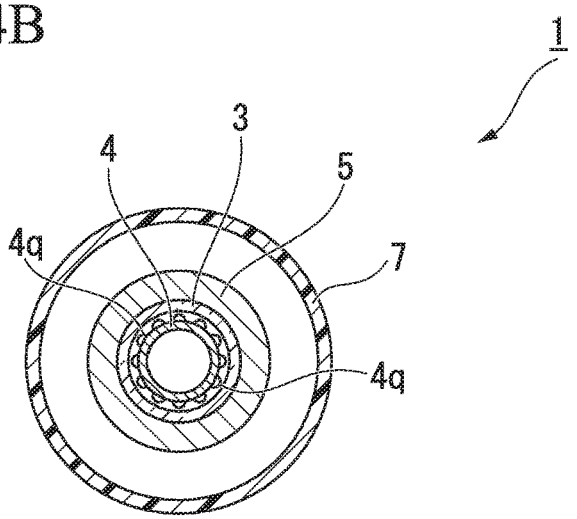
FIG. 4B is a cross-sectional view of the plasma generating apparatus as viewed from the arrow direction of the x2-x2 line of FIG. 4A.

FIG. 4A is a schematic view of the plasma generating apparatus 10 according to a second embodiment of the present invention. FIG. 4B is a cross-sectional view of the plasma generating apparatus 10 as viewed from the arrow direction of the x2-x2 line of FIG. 4A.

With respect to the plasma generating apparatus of this second embodiment, the same components as in the first embodiment are denoted with the same reference numerals as in the first embodiment. Multiple protrusions 4*q* are dispersedly disposed apart from each other on the outer peripheral surface of the inner electrode 4' of the plasma generating apparatus 10. With respect to the outer peripheral surface of the inner electrode 4' shown in FIG. 4, a region thereof (hidden in the drawing) overlapping with the outer electrode 5 has multiple protrusions 4*q* which are dispersedly disposed apart from each other.

As shown in FIG. 4A, the longitudinal directions of the tubular dielectric 3, the outer electrode 5 and the inner electrode 4' coincide with the axial direction D1. As shown in FIG. 4B, the protrusions 4*q* on the outer peripheral surface of the inner electrode 4' face the inner peripheral surface of the outer electrode 5 with the tube wall of the tubular dielectric 3 interposed therebetween. There are a plurality of protrusions 4*q* as points close to the inner peripheral surface of the outer electrode 5.

This configuration enables prevention of local overheating of the inner electrode 4' to which the voltage is applied, and allows for easy generation of a low temperature, atmospheric pressure plasma, which can lower the temperature of the active gas P.

The shape of the outer electrode 5 is not particularly limited as long as the outer electrode 5 can be disposed opposite to the inner electrode 4 (hereinafter, unless otherwise specified, not distinguished from the inner electrode 4'), and examples thereof include a cylindrical shape, a rod shape, a plate shape and the like. Among them, a cylindrical shape is preferable, and a cylindrical shape having such an inner diameter that allows the outer electrode 5 to be installed in close contact with the outer peripheral surface of the tubular dielectric 3 is more preferable. Such a cylindrical shape of the outer electrode 5 enables the outer electrode 5 to be disposed such that the inner peripheral surface of the outer electrode 5 surely faces the outer peripheral surface of the inner electrode 4.

When the outer electrode 5 is in the form of a rod or a plate, the number of the outer electrodes 5 to be installed is not particularly limited, and may be one or two or more. When two or more outer electrodes 5 are installed, it is preferable to dispose the outer electrodes 5 at even intervals on the outer periphery of the tubular dielectric 3, because the places for ionizing the atmospheric pressure plasma generation gas G can be dispersed.

The shape of the cowling 7 is not particularly limited, but is preferably such that the outer electrode 5 and the inner electrode 4 can be accommodated in the hollow portion of the cowling 7. Similarly, it is preferable that the tubular dielectric 3 is also accommodated in the hollow portion of the cowling 7, but the tip end of the tubular dielectric 3 may protrude outside the cowling 7. The cowling 7 preferably has an discharge port 6 for discharging the active gas P generated by the atmospheric pressure plasma (released from the tip end of the tubular dielectric 3) toward an external target for application of the active gas.

The cowling 7 preferably functions as a nozzle for discharging the active gas P generated by the atmospheric pressure plasma generated in the plasma generating unit 2 to the outside of the apparatus. When the discharge port 6 and the nozzle portion of the cowling 7 constituting the discharge port 6 have such sizes that allow the discharge port 6 and the nozzle portion to be inserted into an oral cavity of a living body to be treated, the active gas P generated by the atmospheric pressure plasma can be used for the purpose of dental treatment or aesthetic improvement. Examples of living organisms to be treated include mammals such as dogs and cats (excluding humans) and humans.

The plasma generating apparatus 1 preferably includes a power supply controller (not shown) that controls the voltage and frequency of the power source E that applies a voltage between the outer electrode 5 and the inner electrode 4. As the power supply controller, for example, a known power supply control device can be mentioned.

The plasma generating apparatus 1 preferably includes a dose control device (not shown) for controlling the discharge amount of the active gas P. As an example of the dose control device, a device that controls the amount of the plasma generation gas G introduced into the tubular dielectric 3 can be mentioned. Specific examples of the dose control device include a known mass flow controller for controlling the flow rate of the gas introduced into the tubular dielectric 3 via a pipe from a cylinder (not shown) for the plasma generation gas G.

As described above, the plasma generating unit 2 of the plasma generating apparatus 1 has a simple structure and, hence, can be manufactured at relatively low cost.

<<Method of Using Plasma Generating Apparatus>>

A method of using the plasma generating apparatus 1 of FIG. 1 is illustrated below. A plasma generation gas G supplied from a cylinder is introduced from the rear end portion (first end portion) of the tubular dielectric 3 to the inner hollow portion of the tubular dielectric 3. The plasma generation gas G introduced to the hollow portion of the tubular dielectric 3 is ionized into the atmospheric pressure plasma at the points 4*p* of the inner electrode 4 that are located close to the outer electrode 5. During this process, a voltage is applied between the inner electrode 4 and the outer electrode 5.

The atmospheric pressure plasma generated at multiple locations corresponding to points 4*p* where the outer peripheral surface of the inner electrode 4 and the inner peripheral surface of the outer electrode 5 face each other pass through the inner space of the tubular dielectric 3 and the inner space of the cowling 7, and is led to the discharge port 6. The atmospheric pressure plasma contains excited molecules, atoms, active species and so forth. The composition of the atmospheric pressure plasma changes as the plasma moves farther away from the plasma generating unit 2. The atmospheric pressure plasma cannot maintain the plasma state when it has been led to the discharge port 6, and changes into the active gas P containing active species. In addition, the gas existing in the vicinity of the discharge port 6 reacts with the ejected active gas P, which in some cases results in generation of another active species. As a result, the active species corresponding to the plasma generation gas G and the gas existing in the vicinity of the discharge port 6 are discharged from the discharge port 6. The discharge port 6 is directed toward the target and the active gas P is discharged against the target. Since the hollow portion of the upper end of the cowling 7 is tapered and the discharge port 6 is provided on the top portion thereof, the tip end of the cowling 7 functions as a nozzle.

Examples of the active species (radicals etc.) generated by the atmospheric pressure plasma include hydroxyl radicals, singlet oxygen, ozone, hydrogen peroxide, superoxide anion radicals, nitrogen monoxide, nitrogen dioxide, peroxynitrate, dinitrogen trioxide and the like.

The outer peripheral surface of the inner electrode 4 and the inner peripheral surface of the outer electrode 5 are disposed so as to face each other through the tube wall 3*a* of the tubular dielectric 3 in the hollow portion of the tubular dielectric 3. With this arrangement, multiple points 4*p* where electric field concentration for ionizing the atmospheric pressure plasma generation gas G occurs are dispersed.

As a result, the inner electrode 4 to which the voltage is applied is prevented from being excessively heated locally, and a low temperature, atmospheric pressure plasma is easily generated, whereby the temperature of the active gas P can be lowered.

Similarly to the case where the inner electrode 4 is in the form of a coil, also in the case of the above-mentioned inner electrode having irregularities (bumps and dents) formed on the surface thereof, a low temperature, atmospheric pressure plasma can be easily generated and the temperature of the active gas P can be lowered.

Figure 5A:
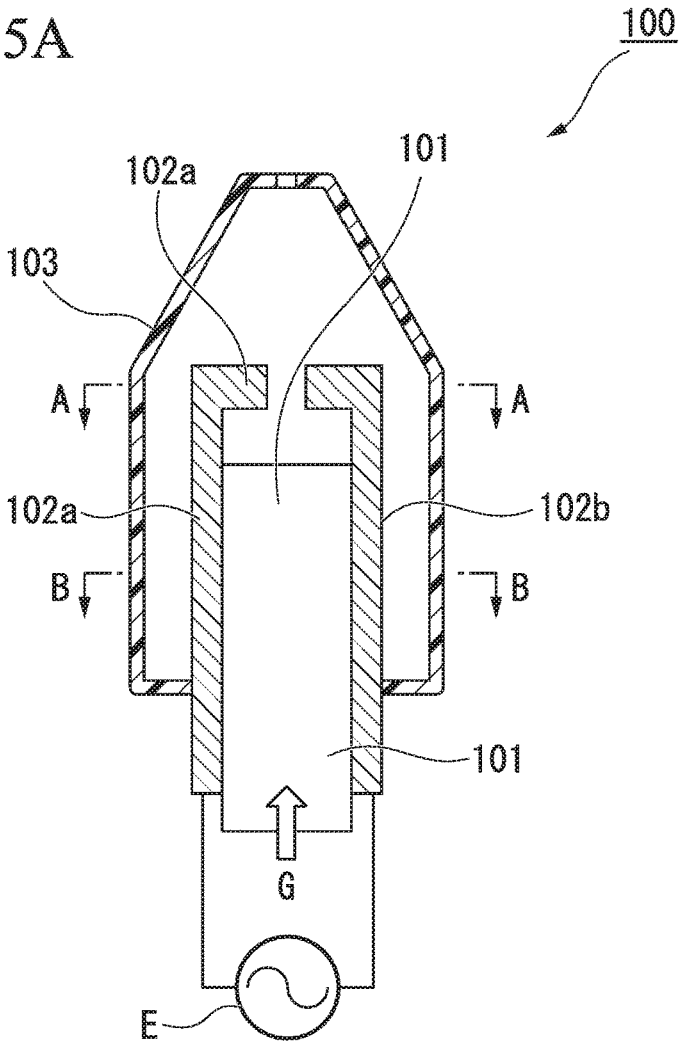
FIG. 5A is a schematic view showing the configuration of a plasma generating unit of a conventional plasma generating apparatus.
Figure 5B:
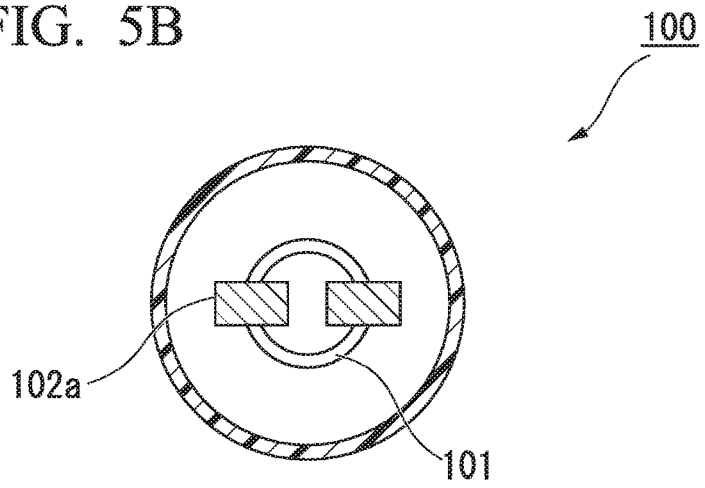
FIG. 5B is a cross-sectional view of the plasma generating apparatus as viewed from the arrow direction of the A-A line of FIG. 5A.
Figure 5C:
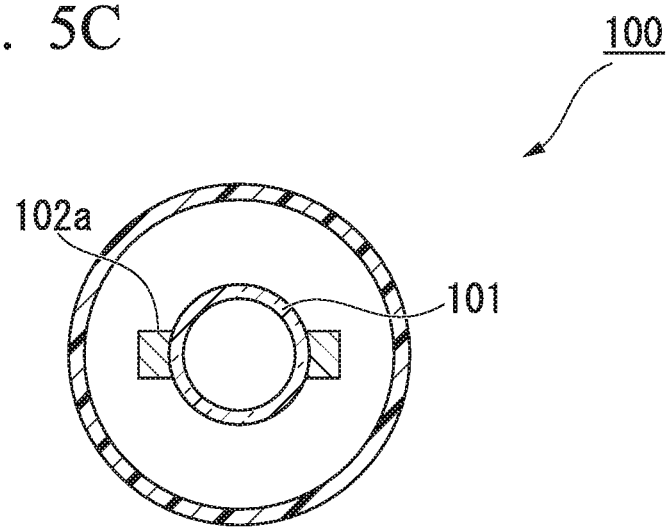
FIG. 5C is a cross-sectional view of the plasma generating apparatus as viewed from the arrow direction of the B-B line of FIG. 5A.

On the other hand, in the conventional plasma generating apparatus 100 of FIG. 5, the electrodes 102*a* and 102*b* are close to each other locally at one point of the tip end of the gas pipe 101, where electric field concentration occurs locally, which causes a problem that the electrodes are overheated at the time of plasma generation and the temperature of the generated atmospheric pressure plasma becomes high.

In the plasma generating apparatus 1, by controlling the voltage applied between the inner electrode 4 and the outer electrode 5 and the frequency thereof by the power supply controller (not shown), the amount of the active species generated by the atmospheric pressure plasma and the temperature of the active gas P can be easily controlled.

By way of example, by applying an alternating voltage controlled within a range of less than 20 kVpp and less than 20 kHz between the outer electrode 5 and the inner electrode 4, an active gas P having a temperature of, for example, 40° C. or less can be generated.

The alternating voltage applied between the inner electrode 4 and the outer electrode 5 is preferably 5.0 kVpp or more and less than 20 kVpp. Here, the unit "Vpp (Volt peak to peak)" representing the alternating voltage means a potential difference between the highest value and the lowest value of the alternating voltage waveform.

By setting the applied alternating voltage to be less than the upper limit value of the above range, the temperature of the generated atmospheric pressure plasma can be kept low and the temperature of the active gas P can be lowered. By setting the frequency of the applied alternating voltage to be not less than the lower limit value of the above range, the atmospheric pressure plasma can be easily generated.

The frequency of the alternating voltage applied between the inner electrode 4 and the outer electrode 5 is preferably 0.5 kHz or more and less than 20 kHz, more preferably 1 kHz or more and less than 15 kHz, further preferably 2 kHz or more and less than 10 kHz, and particularly preferably 3 kHz or more and less than 9 kHz, and most preferably 4 kHz or more and less than 8 kHz.

By setting the frequency of the applied alternating voltage to be less than the upper limit value of the above range, the temperature of the generated atmospheric pressure plasma can be kept low and the temperature of the active gas P can be lowered. By setting the frequency of the applied alternating voltage to be not less than the lower limit value of the above range, the atmospheric pressure plasma can be easily generated.

It is preferable to control the dose of the active gas P discharged from the discharge port 6 to less than 5.0 liter per minute by controlling the amount of the plasma generation gas G introduced into the tubular dielectric 3.

In the plasma generating apparatus 1, it is preferable to adjust the introduction amount of the plasma generation gas G and the dose of the active gas P such that the ratio of the introduction amount to the dose is to be 1:1. Adjusting this ratio to 1:1 makes it easy to control the dose. For example, by controlling the introduction amount to be less than 5.0 liter per minute, the dose can be controlled to be less than 5.0 liter per minute. The introduction amount and the dose can be adjusted to 1:1 by appropriately adjusting the shape of the tubular dielectric 3 and the opening diameter of the discharge port 6.

Each of the introduction amount of the plasma generation gas G and the dose of the active gas P is preferably 0.1 liter or more and less than 10 liter per minute.

When each of the introduction amount and the dose is not less than the lower limit of the above range, it is possible to prevent the temperature of the target surface from being excessively increased.

When each of the introduction amount and the dose is less than the upper limit of the above range, the active gas P can act on the target surface with sufficiently enhanced efficiency. Furthermore, when the target surface is wet, rapid drying of the target surface can be prevented. Furthermore, when the target surface is an affected part of a patient, it is possible to avoid inflicting pain on the patient.

It is preferable to control at least one of the voltage of the AC power supply, the frequency of the AC power supply and the introduction amount of the atmospheric pressure plasma generation gas G such that the temperature of the active gas P discharged from the discharge port 6 is 40° C. or less at a position which is 1 mm or more and 10 mm or less (target distance) away from the discharge port 6.

For example, the temperature of the active gas P at the above-mentioned position can be controlled to be 40° C. or less by setting the voltage and the frequency to fall within the above-mentioned respective preferable ranges, or setting the introduction amount to fall within the above-mentioned preferable range.

The temperature of the active gas P at the target distance is measured by setting a tip end of a rod-shaped thermocouple at the position of the target distance while discharging the active gas P to the air from the discharge port 6.

The type of the atmospheric pressure plasma generation gas G to be introduced into the tubular dielectric 3 is not particularly limited and may be, for example, nitrogen which has not heretofore been used as a plasma generation gas as far as the present inventors are aware, as well as known plasma generation gases such as oxygen, helium, argon and the like.

As described above, the plasma generating unit 2 of the plasma generating apparatus 1 can efficiently ionize the nitrogen gas at the multiple points 4*p* of the inner electrode 4 and easily generate a low temperature nitrogen gas plasma.

The atmospheric pressure plasma generation gas G to be introduced into the tubular dielectric 3 may be one type of gas or a mixture of two or more types of gases.

For generating a nitrogen gas plasma, the volume of nitrogen gas contained in the atmospheric pressure plasma generation gas G to be introduced into the tubular dielectric 3 is preferably more than 50%, more preferably 70% or more, and more preferably 90 to 100%. The type of other gas components in the atmospheric pressure plasma generating gas G is not particularly limited, and for example, a nitrogen gas plasma may be generated from a mixture of air with nitrogen.

"Utilization of Atmospheric Pressure Plasma"

The active gas P generated in the plasma generating apparatus 1 is preferably applied to living bodies such as cells, living tissues, whole bodies of organisms and the like. By applying the active gas P to the living bodies, the living bodies can be treated or activated. For example, the application of the active gas P to an affected part having trauma such as cuts, scratches or burns, or other abnormalities, produces an effect of promoting healing of the trauma and other abnormalities.

When applying the active gas P to an affected area with trauma or other abnormalities, it may be required to reduce the dose of the gas for the purpose of avoiding inflicting pain on the patient. In such a case, by reducing the amount of the plasma generation gas G introduced from the rear end of the tubular dielectric 3 of the plasma generating device 1, the dose of the active gas P discharged from the discharge port 6 can be reduced.

In some cases, it may be required to further promote healing by increasing the concentration of active species in the active gas P. In such a case, a higher concentration of active species can be applied by discharging the active gas P while positioning the discharge port 6 closer to a target portion such that the distance therebetween falls within a range of 0.01 mm or more to 10 mm or less.

In the plasma generating apparatus 1, the temperature of the active gas P can be set to be 40° C. or less; therefore, there is no risk that the target portion is heated to an excessively high temperature even when the discharge port 6 is positioned close to the target portion. For this reason, even when the target portion is an affected part of a patient, the application of the gas can be performed without causing a burn on the affected part.

The active species generated by the nitrogen gas plasma generated in the plasma generating apparatus 1 have an effect of promoting healing of trauma and other abnormalities. As shown in the Examples to be described later, by applying an active gas containing active species generated by the nitrogen gas plasma to cells, living tissues or whole bodies of organisms, the targeted part can be cleaned or activated, or the trauma or other abnormalities on the targeted part can be healed.

Examples of the living tissues include various organs such as internal organs, epithelial tissues covering the body surface and the inner surfaces of the body cavity, periodontal tissues such as gums, alveolar bone, periodontal ligament and cementum, teeth, bones and the like.

That is, the plasma generating apparatus 1 can be suitably used for a therapeutic method, and a method for activating a cell or a living tissue.

For applying an active gas containing active species generated by the nitrogen gas plasma for the purpose of promoting healing of the trauma and other abnormalities, there is no particular limitation with regard to the interval, repetition number and term of the application. For example, when an active gas containing active species generated by nitrogen gas plasma is applied to an affected portion at a dose of 0.5 liter to 5.0 liter per minute, the application conditions preferred for promoting healing are as follows: 1 to 5 times per day, 10 seconds to 10 minutes for each repetition, and 1 to 30 days as total treatment term.

EXAMPLES (Temperature Measurement)

An alternating voltage of 8.2 kVpp and 7 kHz was applied between the outer electrode 5 and the inner electrode 4 using a plasma generating apparatus as shown in FIG. 1 to generate an atmospheric nitrogen gas plasma. An active gas containing active species generated by the nitrogen gas plasma was discharged at 1 liter/min toward the tip end of a rod-shaped thermocouple installed at a distance of 2 mm or 10 mm from the discharge port 6 to measure the temperature. Hereinafter, an active gas containing active species generated by nitrogen gas plasma may be referred to as nitrogen active gas.

As a result, the temperature was 36° C. at a distance of 2 mm from the discharge port 6, and 32° C. at a distance of 10 mm from the discharge port 6.

(Promotion of Wound Healing 1)

A rabbit having equivalent wounds at two locations on its back was prepared, and an atmospheric nitrogen active gas (8.2 kVpp, 7 kHz, 1 liter per minute, 40° C.) was applied to only one of the wounds for 90 seconds from a distance of 5 mm. As a result, a scab was formed on the surface of the wound on day 1 after the application, and the area of the wound shrank on day 3 after the application, showing that healing had progressed. On the other hand, the remaining one of the wounds to which, as a control, the nitrogen active gas was not applied did not change on day 1 after the gas application to the other wound, and a scab began to form on day 3 after the application.

The cellular tissues of the wound were observed on day 7 after the application of the nitrogen active gas to the wound, which revealed that a thick epidermis was regenerated, fibroblasts proliferated, and blood vessels were newly formed.

On the other hand, observation of the cell tissues of the control wound without application of the nitrogen active gas on day 7 after the gas application to the other wound revealed that a thin epidermis was regenerated but neither fibroblast proliferation nor blood vessel neogenesis occurred.

(Promotion of Wound Healing 2)

Another rabbit having equivalent wounds at two locations on its back was prepared, and the same nitrogen active gas as mentioned above was applied to only one of the wounds once a day for 7 consecutive days. The cellular tissues of the wound were observed on day 7 after the application of the nitrogen active gas to the wound, which revealed that a thicker epidermis than in the case of the one-time application was regenerated, fibroblasts proliferated vigorously, and many blood vessels were newly formed.

On the other hand, observation of the cell tissues of the control wound without application of the nitrogen active gas on day 7 after the gas application to the other wound revealed that a thin epidermis was regenerated but fibroblast proliferated only slightly and blood vessel neogenesis did not occur.

(Promotion of Wound Healing 3)

A normal rat (SD rat) having equivalent wounds at three locations on its back was prepared, and an atmospheric nitrogen active gas (8.2 kVpp, 7.4 kHz, 1 liter per minute, 35° C.) was applied to only one of the wounds for 90 seconds from a distance of 1 mm. The application of gas was performed only once immediately after the normal rat was wounded.

For the second wound, the nitrogen active gas was applied under the same conditions as mentioned above one time immediately after the rat was wounded and this application was performed once a day over 5 days. Thus, the nitrogen active gas was applied five times in total.

For the third wound, the nitrogen active gas was not applied.

The conditions of the wounds were compared on day 5 after the rat was wounded. As a result, it was found that healing degrees of the wounds were in the following order from the highest to the lowest: the second wound (daily application), the first wound (one-time application), and the third wound (no application).

From the above results, it is considered that the application of the nitrogen active gas has promoted wound healing.

(Promotion of Wound Healing 4)

The same experiment as the above experiment using the normal rat (SD rat) was conducted except that a diabetic rat (SDT Fatty) was used. As a result, it was found that, as in the case of the "Promotion of Wound Healing 3", healing degrees of the wounds were in the following order from the highest to the lowest: the second wound (daily application), the first wound (one-time application), and the third wound (no application).

From the above results, it is clear that the application of the nitrogen active gas has promoted wound healing.

(Removal of Biofilm)

From an extracted human molars, calculus and dirt were removed using an ultrasonic scaler, followed by mechanically polishing the tooth surface using a dental abrasive. Then, the dental abrasive etc. were removed using an ultrasonic washer, and the resulting was sterilized with ethylene oxide gas, to thereby obtain an experimental tooth material.

A biofilm (plaque) covering a wide range of the surface of the tooth material was allowed to be formed by attaching periodontal disease bacteria (*P. Gingivalis*) to the surface of the tooth material and culturing.

To the biofilm sticking to the surface of the tooth material was applied a nitrogen active gas (8.2 kVpp, 7.4 kHz, 1 liter per minute, 35° C.) for 90 seconds from a distance of 1 mm.

After gently rinsing the tooth material in water after the application of the nitrogen active gas, the tooth surface was observed. As a result, it was found that the biofilm was washed away from the site to which the gas was applied. On the other hand, the biofilm at the site to which the nitrogen active gas was not applied remained attached to the tooth surface.

With respect to a tooth material having a biofilm attached thereto, a comparative experiment was carried out by spraying a simple nitrogen gas instead of the nitrogen active gas. As a result, the biofilm was not able to be removed.

(Treatment of Periodontal Disease 1)

A healthy hamster was caused to be infected with periodontal disease bacteria around its first molar, and a PCR test carried out at a later date confirmed that the periodontal disease bacteria proliferated. To the hamster's gum having inflammation was applied a nitrogen active gas (8.2 kVpp, 7.4 kHz, 1 liter per minute, 35° C.) for 90 seconds from a distance of 1 mm.

On day 1 after the application of the nitrogen active gas, an observation was made to examine the site to which the nitrogen active gas was applied. As a result, it was found that the gingival inflammation was clearly ameliorated. On the other hand, the gingival inflammation at the site to which the nitrogen active gas was not applied showed no amelioration.

(Treatment of Periodontal Disease 2)

To a hamster's gum having the same inflammation as described above was applied a nitrogen active gas (8.2 kVpp, 7.4 kHz, 1 liter per minute, 35° C.) for 90 seconds from a distance of 1 mm. The application of the nitrogen active gas was performed once a day over 7 days. Thus, the nitrogen active gas was applied under the above-mentioned conditions seven times in total.

On day 7 after the first application of the nitrogen active gas, an observation was made to examine the site to which the nitrogen active gas was applied. As a result, it was found that the gingival inflammation had subsided and healed. On the other hand, the gingival inflammation at the site to which the nitrogen active gas was not applied showed almost no amelioration.

(Treatment of Periodontal Disease 3)

A thread was wound around the upper left molar of each of 4 healthy Beagle dogs (body weight 10 kg), and the dogs were fed with soft food to keep the dogs for 21 days under such a condition that dirt easily adheres to the surrounding of the molar, thereby causing gingivitis around the molar which would not cause bleeding upon palpation.

To two of the four Beagle dogs having gingivitis was applied a nitrogen active gas (8.2 kVpp, 7.4 kHz, 1 liter per minute, 35° C.) for 90 seconds from a distance of 1 mm. The application of the nitrogen active gas was performed once every other day for a total of 7 times over 2 weeks.

2 Weeks after the first application of the nitrogen active gas, an observation was made to examine the site to which the nitrogen active gas was applied. As a result, it was found that the inflammation had subsided and healed.

To another one of the four Beagle dogs having gingivitis was applied a nitrogen gas (1 liter per minute, 20 to 25° C.) for 90 seconds from a distance of 5 mm. The application of the nitrogen gas was performed once every other day for a total of 7 times over 2 weeks.

2 Weeks after the first application of the nitrogen gas, an observation was made to examine the site to which the nitrogen gas was applied. As a result, it was found that the inflammation was not ameliorated.

As for the remaining one of the four Beagle dogs having gingivitis, no treatment was performed. An observation was made 2 weeks later to examine the gum. As a result, it was found that the inflammation was not ameliorated.

(Activation of Periodontal Ligament Cells)

Using a 12-well plate, human periodontal ligament cells were seeded in a calcification medium (including a reagent that stains calcified cells red) and cultured by a known method.

To the cultured cells in 3 wells of the 12-well plate was applied a nitrogen active gas (8.2 kVpp, 7.4 kHz, 1 liter per minute, 35° C.) for 90 seconds from a distance of 1 mm above. The wells were observed the next day, and dense red color indicative of calcified cells was observed over a wide area inside the wells.

To the cultured cells in another 3 wells of the 12-well plate was applied a simple nitrogen gas (1 liter per minute, 20 to 25° C.) for 90 seconds from a distance of 1 mm above. The wells were observed the next day, and sporadic light red color spots indicative of calcified cells was observed inside the wells.

As for the cultured cells in still another 3 wells of the 12-well plate, no treatment was performed. The wells were observed the next day, and almost no red color indicative of calcified cells was observed inside the wells.

From the above results, it is considered that the application of a nitrogen active gas activates human periodontal ligament cells and promotes calcification thereof, whereby alveolar bone and teeth are joined to ameliorate periodontal disease.

INDUSTRIAL APPLICABILITY

The present invention is applicable in the medical field.

DESCRIPTION OF THE REFERENCE SIGNS

1 Plasma generating apparatus
3 Plasma generating unit
3 Tubular dielectric
3*a* Tube wall
4 Inner electrode
5 Outer electrode
6 Discharge port
7 Cowling
P Active gas
G Atmospheric pressure plasma generation gas
E Power supply
100 Plasma generating apparatus
101 Gas pipe
102*a* Electrode
102*b* Electrode
103 Nozzle

The invention claimed is:

1. A plasma generating apparatus comprising:

a plasma generating unit comprising a tubular dielectric to which an atmospheric pressure plasma generation gas is introduced, an inner electrode extending in a hollow portion of the tubular dielectric in axial direction of the tubular dielectric and having a coil shape or an irregular surface, and an outer electrode provided outside of the tubular dielectric, the inner electrode and the outer electrode being positioned opposite to each other through the tubular dielectric; and a discharge port for discharging an active gas containing active species generated by the atmospheric pressure plasma generated in the plasma generating unit.

2. The plasma generating apparatus according to claim 1, wherein the outer electrode has a cylindrical shape surrounding an outer peripheral portion of the tubular dielectric.

3. The plasma generating apparatus according to claim 1, wherein the discharge port has a size that allows the discharge port to be inserted into a human oral cavity.

4. The plasma generating apparatus according to claim 1, which further comprises a dose control device that controls a discharge amount of the active gas.

5. A therapeutic method using the plasma generating apparatus of claim 1, which comprises applying an alternating voltage between the outer electrode and the inner electrode to apply the active gas to an affected part of a patient.

6. The therapeutic method according to claim 5, wherein an alternating voltage of less than 20 kVpp and less than 20 kHz is applied between the outer electrode and the inner electrode.

7. The therapeutic method according to claim 5, wherein an amount of the atmospheric pressure plasma generation gas introduced into the tubular dielectric is controlled so as to control the dose of the active gas discharged from the discharge port to less than 5.0 liter per minute.

8. The therapeutic method according to claim 5, wherein at least one of the alternating voltage and the amount of the atmospheric pressure plasma generating gas introduced into the tubular dielectric is controlled to adjust the temperature of the active gas to 40° C. or less as measured at 1 mm or more and 10 mm or less away from the discharge port.

9. The therapeutic method according to claim 5, wherein the atmospheric pressure plasma generation gas is nitrogen gas.

10. The therapeutic method according to claim 5, wherein the affected part is a periodontal tissue or a tooth.

11. The therapeutic method according to claim 5, wherein the affected part is an epithelial tissue.

12. A method for activating a cell by using the plasma generating apparatus of claim 1, which comprises applying an alternating voltage between the outer electrode and the inner electrode to generate an active gas, and applying the active gas to the cell.

13. A method for activating a living tissue by using the plasma generating apparatus of claim 1, which comprises applying an alternating voltage between the outer electrode and the inner electrode to generate an active gas, and applying the active gas to the living tissue.

* * * * *